US009911323B2

(12) United States Patent
Santoso et al.

(10) Patent No.: US 9,911,323 B2
(45) Date of Patent: Mar. 6, 2018

(54) TOOLSTRING TOPOLOGY MAPPING IN CABLE TELEMETRY

(71) Applicant: Schlumberger Technology Corporation, Sugar Land, TX (US)

(72) Inventors: David Santoso, Sugar Land, TX (US); Takeaki Nakayama, Machida (JP); Hiromasa Nishisaka, Sagahimara (JP); Yuichi Kobayashi, Machida (JP); Nalin Weerasinghe, Sagamihara (JP); Milos Milosevic, Houston, TX (US); Eric Jeanson, Sugar Land, TX (US); Kun Wang, Sugar Land, TX (US); Motohiro Nakanouchi, Hachioji (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 448 days.

(21) Appl. No.: 13/705,139

(22) Filed: Dec. 4, 2012

(65) Prior Publication Data

US 2014/0152460 A1 Jun. 5, 2014

(51) Int. Cl.
*E21B 47/12* (2012.01)
*G08C 19/00* (2006.01)

(52) U.S. Cl.
CPC ..... *G08C 19/00* (2013.01); *E21B 47/12* (2013.01)

(58) Field of Classification Search
CPC ..... H04W 88/02; H04W 8/22; H04W 8/245; H04W 40/08; H04W 40/246; H04W 36/0066; H04W 16/26; H04W 84/22; H04W 88/10; H04W 92/02; H04W 92/20; Y10S 128/903; Y10S 707/99943; Y10S 707/99945; Y10S 707/99948;
(Continued)

(56) References Cited

U.S. PATENT DOCUMENTS 4,597,073 A 6/1986 Staples
4,905,234 A 2/1990 Childress et al.
(Continued)

FOREIGN PATENT DOCUMENTS

GB 2393364 3/2004
GB 2408432 5/2005
(Continued)

OTHER PUBLICATIONS

Extended Search Report issued in the related EP Application 13195180.8, dated Jan. 12, 2018 (6 pages).

*Primary Examiner* — Nay Tun
(74) *Attorney, Agent, or Firm* — Trevor G. Grove

(57) ABSTRACT

Toolstring topology mapping systems having a downhole toolstring including a master node controller and a plurality of nodes and related methods. The methods involve querying each of the plurality of nodes in the downhole toolstring for actual topology information, receiving actual topology information from each of the plurality of nodes in the downhole toolstring in response to querying, and generating a topology map of the downhole toolstring based on the actual topology information from each of the plurality of nodes in the downhole toolstring. The methods can also involve comparing the topology map with the input topology information to identify topology mismatch and then take remedial actions if needed.

16 Claims, 13 Drawing Sheets

(58) Field of Classification Search
CPC ... H04L 41/065; H04L 41/22; E21B 47/0002; E21B 47/09; E21B 47/0905; E21B 49/00; E21B 47/12; G06F 17/30241; G05B 19/4184; G01V 1/34; G01V 11/00; G01V 1/22; G01V 1/44; G01V 2200/12; G01V 3/26; G01V 9/00; G09B 29/006; G09B 29/10; G09B 29/106; G08C 19/00
See application file for complete search history.

(56) References Cited

U.S. PATENT DOCUMENTS

| | | | | |
|---|---|---|---|---|
| 5,191,326 | A | 3/1993 | Montgomery | |
| 5,331,318 | A | 7/1994 | Montgomery | |
| 5,592,438 | A | 1/1997 | Rorden et al. | |
| 5,719,883 | A | 2/1998 | Ayanoglu | |
| 5,737,319 | A * | 4/1998 | Croslin et al. | 370/255 |
| 5,784,004 | A | 7/1998 | Esfahani et al. | |
| 5,838,727 | A | 11/1998 | Lyon et al. | |
| 5,995,449 | A | 11/1999 | Green et al. | |
| 6,061,633 | A | 5/2000 | Fukuhara et al. | |
| 6,175,599 | B1 | 1/2001 | Lyon et al. | |
| 6,252,518 | B1 | 6/2001 | Laborde | |
| 6,310,559 | B1 | 10/2001 | Laborde et al. | |
| 6,519,568 | B1 | 2/2003 | Harvey et al. | |
| 6,552,665 | B1 | 4/2003 | Miyamae et al. | |
| 6,580,751 | B1 | 6/2003 | Gardner et al. | |
| 6,628,992 | B2 | 9/2003 | Osburn, III | |
| 6,630,890 | B1 * | 10/2003 | Endo | G01V 1/52 181/122 |
| 6,657,551 | B2 | 12/2003 | Huckaba et al. | |
| 6,747,569 | B2 | 6/2004 | Hill et al. | |
| 6,999,517 | B1 | 2/2006 | Bombay et al. | |
| 7,026,952 | B2 | 4/2006 | Krueger | |
| 7,042,367 | B2 | 5/2006 | Gardner et al. | |
| 7,081,831 | B2 | 7/2006 | Dodge | |
| 7,096,961 | B2 | 8/2006 | Clark et al. | |
| 7,132,958 | B2 | 11/2006 | Dodge et al. | |
| 7,181,515 | B2 | 2/2007 | Lin et al. | |
| 7,193,525 | B2 | 3/2007 | Miyamae et al. | |
| 7,394,752 | B2 | 7/2008 | Hasegawa et al. | |
| 7,443,312 | B2 | 10/2008 | Quintero et al. | |
| 7,480,207 | B2 | 1/2009 | Marsh | |
| 7,668,117 | B2 * | 2/2010 | Johnson et al. | 370/254 |
| 7,787,525 | B1 | 8/2010 | Clark, Jr. et al. | |
| 8,217,802 | B2 | 7/2012 | Weerasinghe | |
| 8,306,638 | B2 * | 11/2012 | Jung et al. | 700/66 |
| 2002/0178295 | A1 | 11/2002 | Buczek et al. | |
| 2004/0155794 | A1 | 8/2004 | Gardner | |
| 2004/0156264 | A1 | 8/2004 | Gardner et al. | |
| 2005/0046592 | A1 | 3/2005 | Cooper et al. | |
| 2007/0046498 | A1 * | 3/2007 | Jung et al. | 340/853.1 |
| 2007/0189166 | A1 * | 8/2007 | Johnson | E21B 47/12 370/230 |
| 2008/0047751 | A1 * | 2/2008 | Yamate | E21B 47/00 175/50 |
| 2008/0316048 | A1 | 12/2008 | Abdallah | |
| 2009/0190484 | A1 * | 7/2009 | Johnson | H04L 41/12 370/252 |
| 2010/0097884 | A1 * | 4/2010 | Golparian | 367/13 |
| 2010/0194586 | A1 | 8/2010 | Tjhang et al. | |
| 2010/0295702 | A1 | 11/2010 | Zhao et al. | |
| 2011/0005835 | A1 | 1/2011 | Li | |
| 2014/0152457 | A1 | 6/2014 | Nishisaka et al. | |

FOREIGN PATENT DOCUMENTS

| | | |
|---|---|---|
| WO | 2001095517 | 12/2001 |
| WO | 2008005054 | 1/2008 |
| WO | 2013101581 A1 | 7/2013 |

* cited by examiner

TOOLSTRING TOPOLOGY MAPPING IN CABLE TELEMETRY

BACKGROUND

The following descriptions and examples are not admitted to be prior art by virtue of their inclusion in this section.

Hydrocarbon fluids, such as oil and natural gas, may be obtained from a subterranean geologic formation, referred to as a reservoir, by drilling a well that penetrates a hydrocarbon-bearing formation. A variety of downhole tools may be used in various areas of oil and natural gas services. In some cases, downhole tools may be used in a well for surveying, drilling, and production of hydrocarbons. The downhole tools may communicate with the surface via various telemetry systems. In some cases, the downhole tools may comprise one or more individual modules in operative communication with one another, such as a master module and multiple slave modules. Examples of communication systems are provided in U.S. Pat. Nos. 6,628,992, 7,181,515, and 20020178295.

With the increased precision of downhole tools and sensors, relatively shorter time may be available to send increasingly larger amounts of data. In addition to new modules and assemblies being developed for downhole use on a continuing basis, tool bus systems may facilitate communication between older and newer generation modules in order to obtain the maximum service life from existing modules.

Applications of disclosed embodiments of the present disclosure are not limited to these illustrated examples, different industrial applications may benefit from implementations of the following disclosure.

SUMMARY

In at least one aspect, the disclosure relates to a method for toolstring topology mapping. The method involves providing a downhole toolstring including a master node controller and one or more tools each with a respective node. The method also involves querying each of the nodes in the one or more tools for actual topology information, receiving the actual topology information from each of the nodes in response to the querying, and generating a topology map of the downhole toolstring based on the actual topology information.

In at least another aspect, the disclosure relates to a system for toolstring topology mapping. The system can include a cable operatively coupling between a downhole toolstring and a surface computer. The downhole toolstring includes one or more tools each with a respective node. The downhole toolstring further includes a master node controller that, in response to powering up the downhole toolstring, the master node controller queries each of the nodes in the respective tools for actual topology information and generates a topology map of the downhole toolstring. The surface computer includes a user interface that receives expected input topology information relating to each of the nodes.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of systems, apparatuses, and methods for toolstring topology mapping in cable telemetry are described with reference to the following figures. Like numbers are used throughout the figures to reference like features and components.

DETAILED DESCRIPTION

In the following description, numerous details are set forth to provide an understanding of the present disclosure. However, it will be understood by those skilled in the art that the present disclosure may be practiced without these details and that numerous variations or modifications from the described embodiments are possible.

The disclosure relates to systems, apparatuses, and methods for investigating and mapping a toolstring topology that is indicative of the number of tools, type of interface package, and capabilities for each node in a downhole toolstring using cable telemetry, enabling overall system data communication reliability and supporting different generation tools with different communication capabilities in a single toolstring.

Communication through the system may be passed by uplink or downlink. "Uplink" may be used to generally refer to any communication transferring data from a downhole tool to the surface, while "downlink" may be used to generally refer to any communication of a command or data from the surface to one or more downhole tools.

"Topology," as used herein, refers to a manner in which tools are assembled together communicatively in a toolstring, and the way a tool bus of the toolstring is constituted communicatively using various tool bus nodes. A "topology map" may be the result of a topology investigation, which indicates what tools are connected to each other, and the capabilities of the interface package of each tool in the string. A topology map may be used to confirm that the capabilities expected (based on what the user believes has been deployed into the wellbore) correspond to capabilities of devices deployed in the wellbore, and to increase reliability while coordinating various generations of downhole tools having different communication capabilities, such as data bandwidth.

Toolstring Topology Mapping

Figure 1:
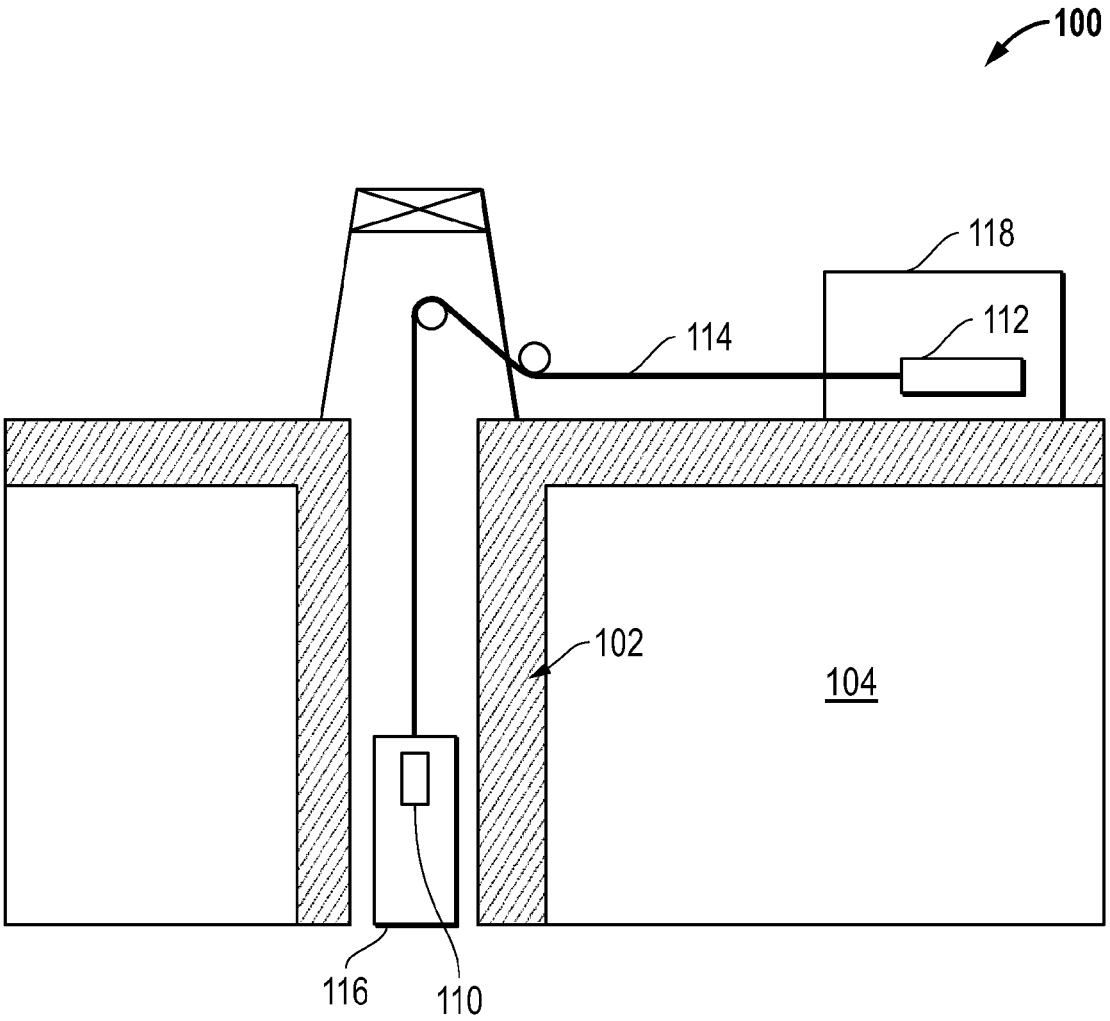
FIG. 1 is a schematic representation of a well site system, with a borehole traversing subsurface formations.

Referring to FIG. 1, an example embodiment of wireline logging operation is illustrated with respect to the wellsite system 100 employed in a wellbore 102 traversing a subsurface formation 104. A downhole telemetry cartridge 110 is connected to a toolstring 116. In a well-logging operation, a plurality of tools may be connected in the toolstring 116. The tools of the toolstring 116 communicate with the downhole telemetry circuits of downhole telemetry cartridge 110 via a bi-directional electrical interface.

In some embodiments, the tools of the toolstring 116 may be connected to the telemetry cartridge 110 over a common data bus. In some embodiments, each tool of the toolstring 116 may be individually, directly connected to the telemetry cartridge 110. In some embodiments, the telemetry cartridge 110 may be a separate unit, which is mechanically and electrically connected to the tools in the toolstring 116. In some embodiments, the telemetry cartridge 110 may be integrated into a housing of one of the well-logging tools in the toolstring 116.

The telemetry cartridge 110 can be operatively coupled to a wireline cable 114. The tools of the toolstring 116, including the telemetry cartridge 110, may be lowered into the wellbore 102 on the wireline cable 114.

A surface data acquisition computer 118 is located at the surface end of the wireline cable 114. The surface data acquisition computer 118 includes or couples to an uphole telemetry unit 112. The data acquisition computer 118 may provide control of the components in the toolstring 116 and process and store the data acquired downhole. The acquisition computer 118 may communicate with the uphole telemetry unit 112 via a bi-directional electrical interface.

The uphole telemetry unit 112 may modulate downlink commands from the acquisition computer 118 for transmission down the cable 114 to the toolstring 116, and demodulates uplink data from the toolstring 116 for processing and storage by the surface data acquisition computer 118.

The downhole telemetry cartridge 110 contains circuitry to modulate uplink data from the tools of the toolstring 116 for transmission up the wireline cable 114 to the surface data acquisition computer 118 and to demodulate downlink commands from the surface data acquisition computer 118 for the tools of the toolstring 116.

Figure 2:
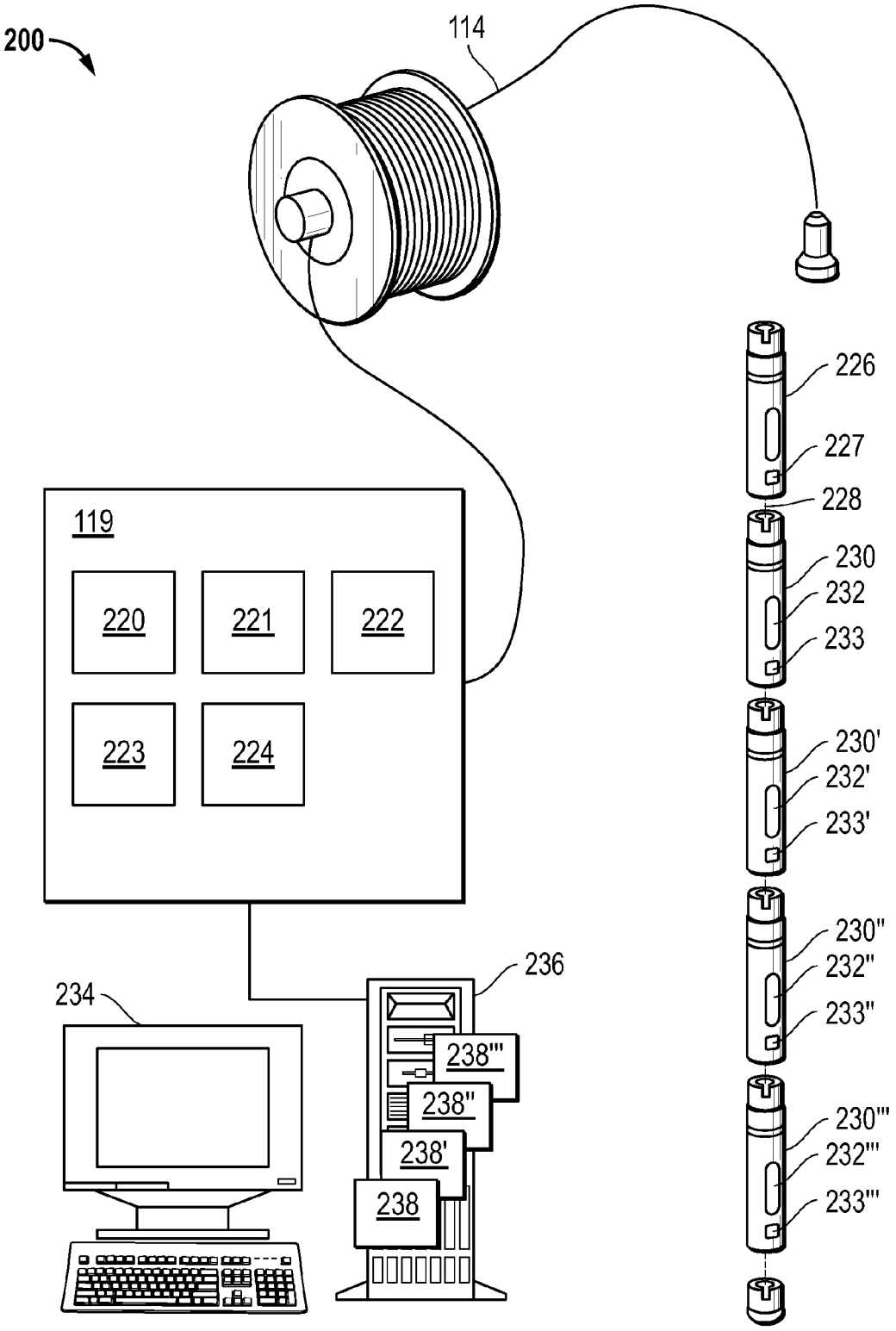
FIG. 2 illustrates schematically an example cable telemetry system for monitoring subterranean formations in accordance with an embodiment of the present disclosure.

A more detailed schematic view of one example cable telemetry system 200 is shown in FIG. 2. The cable telemetry system 200 shown includes a surface acquisition module/surface modem (DTM) 220 having a telemetry interface module 222, which can be located at the surface as a portion of or operatively coupled to the surface data acquisition front end 119 (a component of surface data acquisition computer 118 of FIG. 1). The surface data acquisition front end 119 is coupled to the wireline cable 114, and a downhole modem (DTC) 226 (as a portion of the downhole telemetry cartridge 110 at the head of a toolstring 116 of FIG. 1) which includes a number of downhole tools, 230, 230', 230", 230'", etc. The downhole tools 230, 230', etc., each contains a respective interface package 232, 232', 232", 232'", through which they are in communication with the DTC 226 via a tool bus 228. The downhole tools 230, 230', 230", 230'" may also have tool node controllers 233, 233', 233", 233'", respectively.

The cable telemetry system 200 may handle data flows in opposite directions (i.e., from the tools 230, 230', etc.) via the respective interface package 232, 232', etc. and the tool bus 228. The flow extends to the DTC 226 to the DTM 220 over the cable 114 ("uplink"), and the reverse direction from the DTM 220 to the DTC 226 and tools 230, 230', etc., over the same path ("downlink"). The cable telemetry system 200 provides a communication path from the tools, 230, 230', etc., to the DTM 220 of the data acquisition computer 118 so that data acquired by the tools, 230, 230', etc., can be processed and analyzed at the surface, as well as communication between tools 230, 230', etc.

Each individual tool (230, 230', etc.) may include a node command buffer (not shown) at the interface package 232, 232', etc. as well as a logic controller of its own (not shown). The surface acquisition front-end unit 119 may also include various additional components, such as power module 221, depth and tension module 223, flow controller software module (FEPC) 224.

The downhole telemetry cartridge 226 can include a downhole master node controller 227 that may examine packets sent by each respective tool 230, 230', etc. Data communicated in either direction may be copied and buffered at the master node controller 227, and sent to the recipient.

A surface computer 234 can store and execute a surface computer data dispatcher module 236 (which may be, in an embodiment, a software data routing module, such as SCHLUMBERGER™'s MAXWELL™ framework). The surface computer 234 has a memory module to store and execute a plurality of surface tool-specific applications 238, 238', 238", 238'", etc. that analyze and use data obtained, respectively, by tools 230, 230', etc.

The master node controller 227, residing in the DTC 226 may query each node in the toolstring and each node responds with the requested information. The requested information may include, for example, the identity of the tool at the queried node, the generation or capabilities of the interface package for the queried node. In an embodiment, during the topology investigation some communication between the DTC 226 and the surface computer 234 may be halted. In an embodiment, during the topology investigation, surface tool applications 238, 238', etc. for each tool 230, 230', etc. may not send commands to downhole tools and tool messages may not be sent to surface tool applications 238, 238', etc.

In an embodiment, the master node controller 227 may begin a topology investigation automatically, after a predetermined period of time elapses and/or after determining that the toolstring 116 is powered up, (i.e., that the head voltage is in a normal operating range). Thus, the topology investigation may not depend on surface commands or completion of a successful cable training phase, as disclosed in related and commonly assigned application entitled "TOOLSTRING COMMUNICATION IN CABLE TELEMETRY" U.S. patent application Ser. No. 13/705,137, filed on Dec. 4, 2012, also published as U.S. Patent Application Publication 2014-0152457) filed concurrently herewith.

In an embodiment, the topology investigation may take a short period of time to complete (for example, less than about 1 second to complete) and, thus the resulting topology map may be available before the completion of cable telemetry training. The result of the topology investigation is the topology map, which is stored in the master node controller 227. In an embodiment, the master node controller 227 will send the topology map to the surface using a tool message of DTC 226 upon completion, or as soon as the cable link telemetry is up.

In an embodiment, the surface computer data dispatcher module 236 compares the topology map with the input topology information acquired from the user during a setup input to determine if a mismatch is present. If, for example, the number of tools in the topology map does not correspond to the input topology information acquired from the user, a command may be sent to the DTC 226 to repeat the topology investigation. Optionally, in case of tool detection failure or other mismatch between the input topology information and the topology map, the master node controller 227 may repeat the topology investigation up until a threshold is reached, for example, repeating the topology investigation up to three times.

There are a number of reasons that could lead to a mismatch between the topology map and the input topology information, for example, a surface computer database storing the characteristics of each tool may not be up-to-date with the particular tool asset used in the present job (i.e., the actual tool in the wellbore may have been upgraded without the database information being updated), the user (i.e., field engineer) may have placed the tool in a wrong position in the toolstring 116, or a wrong tool or a wrong file code could have been selected during setup by the user.

A tool version naming convention may be adopted for illustrating the concepts herein. Tool bus generations may be referred to herein as downhole tool bus (DTB), Fast Tool Bus (FTB), Enhanced Fast Tool Bus (EFTB). EFTB 2.0 is designed as an improvement over its predecessor EFTB and supports up to 8 Mbps of uplink data rate, which is 4 times the data rate of EFTB. Tool bus slaves are referred to as Interface Package (IP) for FTB, Enhanced Interface Package (EIP) for EFTB, and EIP 2.0 for EFTB 2.0 respectively. An EIP can behave as an IP or an EIP depending on the configuration and similarly EIP 2.0 can behave as IP, EIP or EIP 2.0.

In a wireline telemetry system in accordance with the present disclosure, which may be SCHLUMBERGER's™ Enhanced Digital Telemetry System EDTS 2.0, the cable telemetry system may support EFTB and FTB legacy tools, various tool design embodiments may use EFTB 2.0. DTB is supported in the presence of a tool bus adapter called Digital Telemetry Adapter (DTA) or Enhanced Digital Telemetry Adapter (EDTA). The others are natively supported by EDTS 2.0, which means that any tool using the mentioned tool bus is supported in EDTS 2.0.

Figure 3:
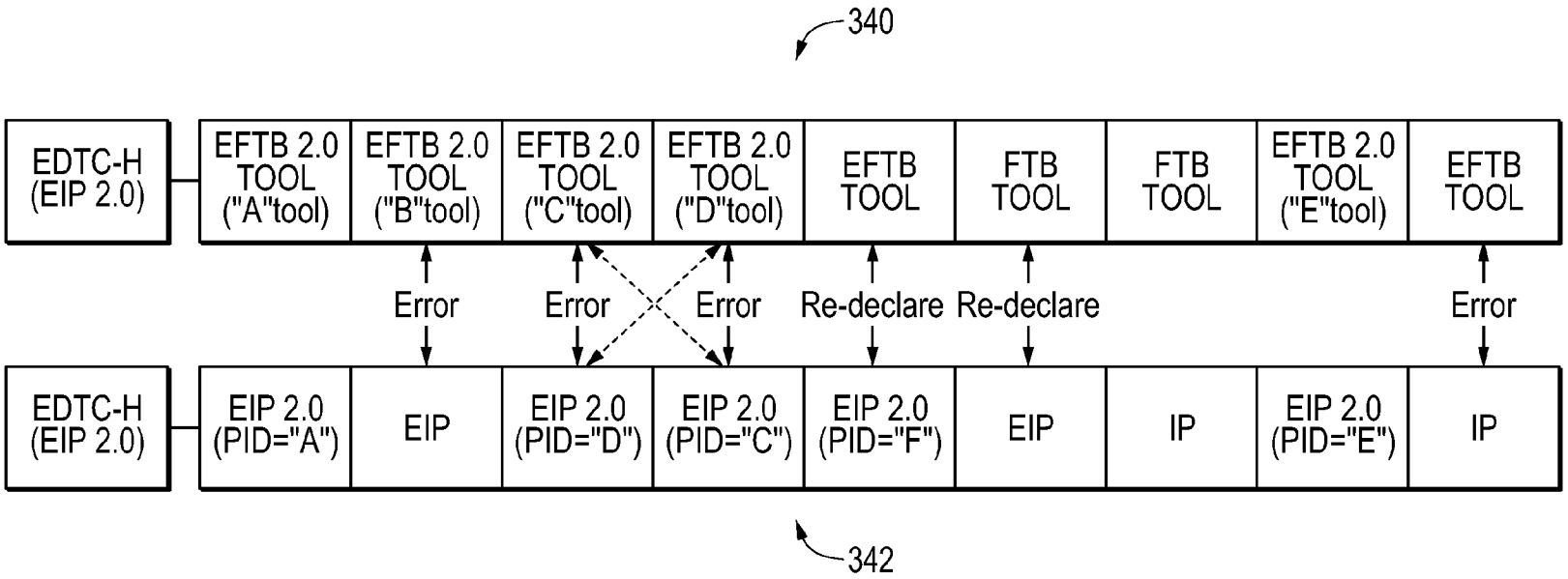
FIG. 3 illustrates a block diagram for an input toolstring as entered by a user during setup compared to a topology map resulting from a topology investigation in accordance with an embodiment of the present disclosure.

Turning now to FIG. 3, a block diagram is shown illustrating a declared toolstring 340 as entered during setup (top) compared to a topology map 342 resulting from topology investigation (bottom). In the example of FIG. 3, the toolstring 340 is not identical to the topology map 342 determined during the topology investigation (either in actual hardware based on the identifier or interface package firmware).

Toolstring 340, starting from left to right in the top half of FIG. 3, shows a DTC 226 (labeled as EDTC-H for Enhanced Digital Telemetry Cartridge) with an interface package (e.g., in this example, labeled as Enhanced Interface Package 2.0 or EIP 2.0). In the toolstring 340 attached to the DTC, there are 9 tools. Each tool has a tool bus generation (e.g., SCHLUMBERGER's™ Enhanced Fast Tool Bus 2.0 (EFTB 2.0)), Schlumberger's Fast Tool Bus (EFTB), SCHLUMBERGER's™ Enhanced Fast Tool Bus (FTB), a unique physical tool ID (PID) identifying the hardware, and interface package identifier (e.g., SCHLUMBERGER's™ Enhanced Interface Package 2.0 (EIP 2.0), SCHLUMBERGER's™ Enhanced Interface Package (EIP), and SCHLUMBERGER's™ Interface Package (IP)). The various tools may be selected from various commercially available tools from SCHLUMBERGER TECHNOLOGY CORPORATION™; see: www.slb.com.

The First Tool is labeled with a PID as "A" tool, with hardware used being an EFTB 2.0 tool in toolstring 340. The corresponding first tool in the topology map 342 is shown as having the PID for "A" Tool and running interface package EIP 2.0. Since EIP 2.0 is the interface package generation corresponding to EFTB 2.0 tools, the declared toolstring 340 and the topology map 342 match for the first tool.

The Second Tool is labeled with a PID as "B" Tool, with hardware used being an EFTB 2.0 tool in toolstring 340. The corresponding second tool in the topology map 342 is shown as running interface package EIP. Since EIP is the interface package generation that corresponds to EFTB tools, and not EFTB 2.0 tools, the declared toolstring 340 and the topology map 342 show a mismatch or error for the second tool.

The Third Tool is labeled with a PID as a "C" Tool, with hardware being used as an EFTB 2.0 tool in toolstring 340. The corresponding third tool in the topology map 342 is shown as running interface package EIP 2.0, which corresponds to EFTB 2.0, however the PID for the third tool in the topology map 342 is PID "D" Tool, which is different from the PID "C" Tool in the declared toolstring 340. Accordingly the declared toolstring 340 and the topology map 342 show a mismatch or error for the third tool.

The Fourth Tool is labeled with a PID as a "D" Tool, with hardware being used as an EFTB 2.0 tool in toolstring 340. The corresponding fourth tool in the topology map 342 is shown as running interface package EIP 2.0, which corresponds to EFTB 2.0, however, the PID for the fourth tool in the topology map 342 is PID "C" Tool, which is different from the PID "D" Tool in the declared toolstring 340. Accordingly the declared toolstring 340 and the topology map 342 show a mismatch or error for the fourth tool.

The order of the third and fourth tools in the topology map 342 is shown as switched resulting in a mismatch on PID for both tools and indicating an error for Tools C and D.

The Fifth Tool is declared as using hardware of an EFTB tool (PID irrelevant for this tool) in toolstring 340. The corresponding fifth tool in the topology map 342 is reported as running interface package EIP 2.0 with a PID as "F" tool. Since an EIP 2.0 may function in a backwards compatible manner as an EIP, which is the interface package associated with EFTB tools, the system may prompt the user to re-declare, or re-enter, the hardware to confirm the tools are correct, or allow the interface package as shown in the topology map 342, to function in a backwards compatible mode, as described above.

The Sixth Tool is declared as using hardware of an FTB tool in toolstring 340. The corresponding sixth tool in the topology map 342 is reported as running interface package EIP. Since an EIP may function in a backwards compatible manner as IP, which is the interface package associated with FTB tools, the system may prompt the user to re-declare, or re-enter, the hardware to confirm the tools are correct, or allow the interface package as shown in the topology map 342, to function in a backwards compatible mode, as described above.

The Seventh Tool is declared in toolstring 340 as using hardware of an FTB tool. The corresponding seventh tool in the topology map 342 is reported as running interface package IP. Since IP is the interface package associated with FTB, the declared toolstring 340 and the topology map 342 match for the seventh tool.

The Eighth Tool is declared in the toolstring 340 as using hardware EFTB 2.0 with a PID as an "E" tool. The corresponding eighth tool in the topology map 342 has PID "E" tool as well, and indicates an interface package EIP 2.0. Since EIP 2.0 is the interface package associated with EFTB 2.0 tools, and the PID is "E" tool for both the declared toolstring 340 and the topology map 342, there is a match for the eighth tool.

The Ninth Tool is declared in the toolstring 340 as using hardware EFTB. The corresponding ninth tool in the topology map 342 indicates an interface package IP. Since EIP is the interface package associated with EFTB tools, the declared toolstring 340 and the topology map 342 show a mismatch or error for the ninth tool.

Thus, the topology map acquired during investigation and reflecting what is actually disposed in the wellbore, does not correspond for all nine tools to what the field engineer entered, or declared, during setup. Based on a comparison between the topology map and the input topology information, the user can be alerted to remedy the cause for the mismatch.

Figure 4:
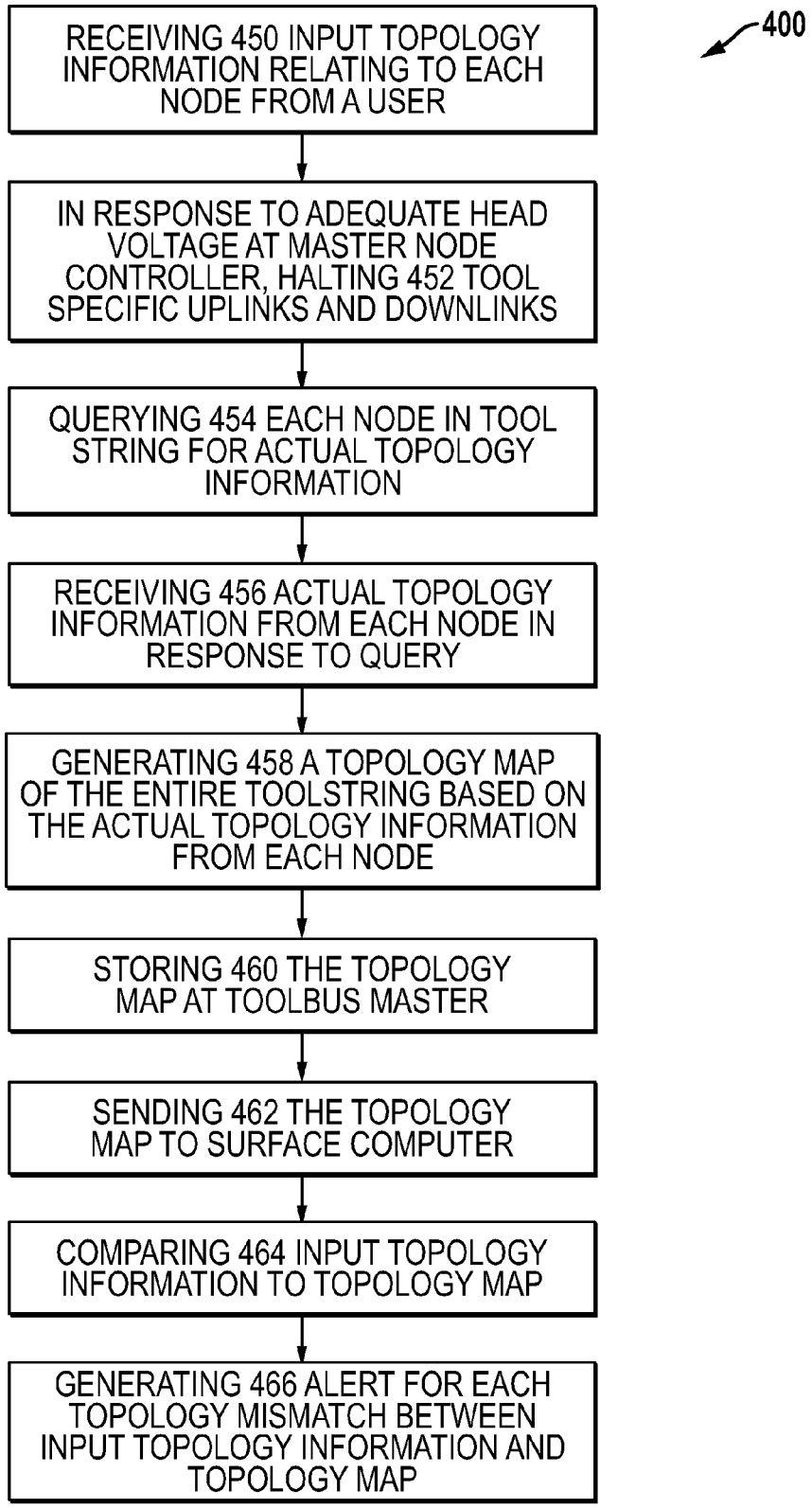
FIG. 4 illustrates a flow chart for a method for toolstring topology mapping of a downhole toolstring in cable telemetry in accordance with an embodiment of the present disclosure.

Turning now to FIG. 4, a flow chart is shown for a method for toolstring topology mapping of a downhole toolstring in cable telemetry. The method 400 for toolstring topology mapping of a downhole toolstring in cable telemetry may be applied, for example, in the system 200 of FIG. 2.

The method can include receiving 450 input topology information relating to each node from a user (e.g., by a user interface of the surface computer 234). The input topology information relates to each node in the downhole toolstring, and may include, for example, an input number of tools in the toolstring, an input tool identifier for each node of the toolstring, an input interface package identifier for each node of the toolstring, and an input relative order of the tools in the downhole toolstring. Additionally, in an embodiment, the method can include halting 452 tool-specific uplinks and downlinks. Such halting may halt uplink and downlink communications until the topology map is complete, and may be performed in response to adequate head voltage at a master node controller.

The method can then query 454 each node in the toolstring for actual topology information. The method can continue with receiving 456 actual topology information from each node in response to querying. Actual topology information for each node may include identifying information, such as the actual number of tools in the toolstring, the actual tool identifier for each node, the actual identifier for interface package (which may be related to which generation the tool is) for each node, and the actual relative order of the tools in the downhole toolstring.

The method can continue with generating 458 a topology map of the downhole toolstring based on the actual topology information from each node. The method can continue with storing 460 the topology map at the master node controller 227. The method can continue with sending 462 the topology map to the surface computer 234.

The method can continue with comparing 464 the input topology information to the topology map, and generating 466 an alert for each topology mismatch between the input topology information and the topology map. The topology mismatch may involve one or more of: 1) the input number of tools in the toolstring does not match the actual number of tools in the toolstring, 2) the input tool identifier for a single node of the toolstring does not match the actual tool identifier for that node of the toolstring, 3) the input identifier for an interface package for a single node of the toolstring does not match the actual identifier for the interface package for that node of the toolstring, and 4) the input relative order of the tools in the toolstring does not match the actual relative order of the tools in the downhole toolstring.

In an embodiment, the querying of the nodes may begin automatically, such as in response to an adequate head voltage measurement at the master node.

A topology mismatch may be indicative, for example, that: 1) the input number of tools in the toolstring does not match the actual number of tools in the toolstring, 2) the input tool identifier for a single node of the toolstring does not match the actual tool identifier for that node of the toolstring, 3) the input identifier for an interface package for a single node of the toolstring does not match the actual identifier for the interface package for that node of the toolstring, or 4) the input relative order of the tools in the toolstring does not match the actual relative order of the tools in the downhole toolstring.

Figure 5:
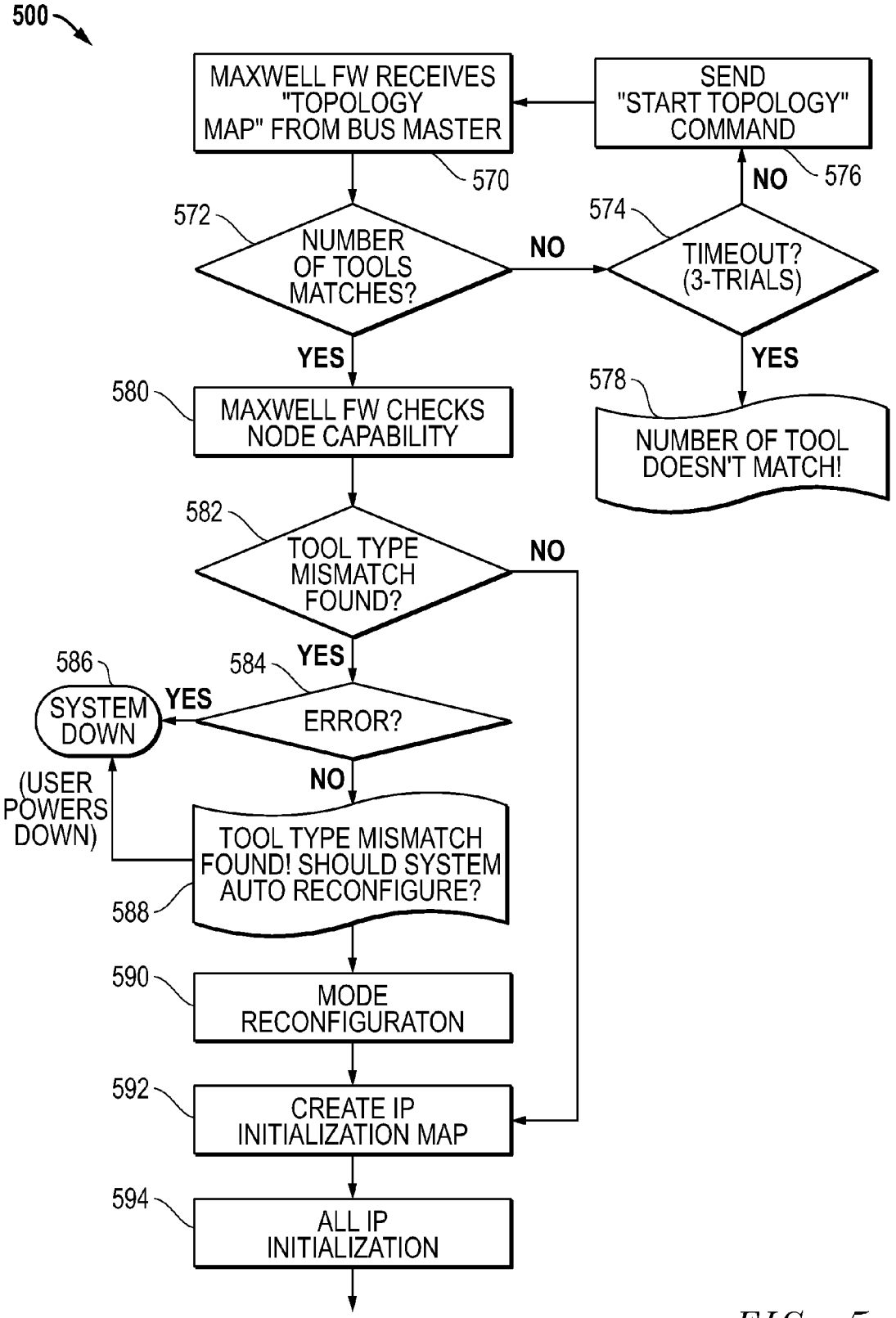
FIG. 5 is a flow chart illustrating a method of generating final settings of a toolstring, based on a topology investigation in accordance with the present disclosure.

Turning now to FIG. 5, a flow chart is shown for a method 500 used, for example, by surface computer 234 of FIG. 2 to arrive at the final settings of the toolstring, based on the topology investigation as described above. In block 570, the surface computer data dispatcher module (e.g., MAXWELL™ framework) 236 receives the topology map from the master node controller (or bus master) 227, generated in an embodiment, as described with respect to FIG. 4.

In block 572, a comparison is made of the number of tools entered by the user to the number of tools in the topology map to determine if there is a match. If not, then in block 574, a determination is made as to whether the topology investigation has timed out (i.e., the actual number of tools has not matched the input number of tools at least a threshold number of times). If not, the portion of the topology investigation for determining the actual number of tools in the toolstring is repeated, with a command (e.g., start topology) being sent to the master node controller 227 to restart the topology investigation in block 576. However, if at block 574, the topology investigation has timed out, an alert is generated to the user in block 578 that the number of tools does not match.

Returning to the comparison of the number of tools at block 572, when the number of tools does match, in block 580 the surface computer data dispatcher 236 checks node capability, which may be based on, for example, the interface package for each individual node. At block 582, a comparison is made for a type mismatch of the input capability of each node (i.e., the interface package for each node as identified by the user) to the actual capability of each node in the topology map. If no mismatch is found at block 582, the method can proceed to block 592 to create an interface package initialization map, and generate an alert at block 594 that the interface packages have been initialized.

If, however, at block 582 a tool mismatch is identified (that is, different interface package capabilities are shown in the topology map than the input information for the same node), then in block 584, the surface computer data dispatcher 236 may declare an error and ask the user whether to shut down at block 586, or to initiate an auto-reconfiguration at block 588, optionally displaying to the user where mismatches are identified in the toolstring.

At block 590, the master node controller 227 may reconfigure the modes (i.e., interface package) for each of the nodes in the toolstring, and create an interface package initialization map 592, after which the method 500 may reiterate.

Toolstring Topology Mapping Explanation

The following information provides additional explanation relating to the techniques as depicted in FIGS. 1-5. This explanation uses SCHLUMBERGER™ MAXWELL™ systems and framework commercially available from SCHLUMBERGER™ (see: www.slb.com), but other systems and framework may be employed. The present disclosure implements topology investigation, topology, and tool selection information reconciliation, a unique Physical Tool ID (PID) for Enhanced Fast Tool Bus 2.0 tools, and can support, for example, up to about 31 tool nodes excluding EDTC-H, and legacy tool (FTB, EFTB 1.0 tools). The topology investigation and PID may be used to provide system reliability, and support different generations of wireline tools that have different communication capabilities (e.g., data bandwidth).

Figure 6:
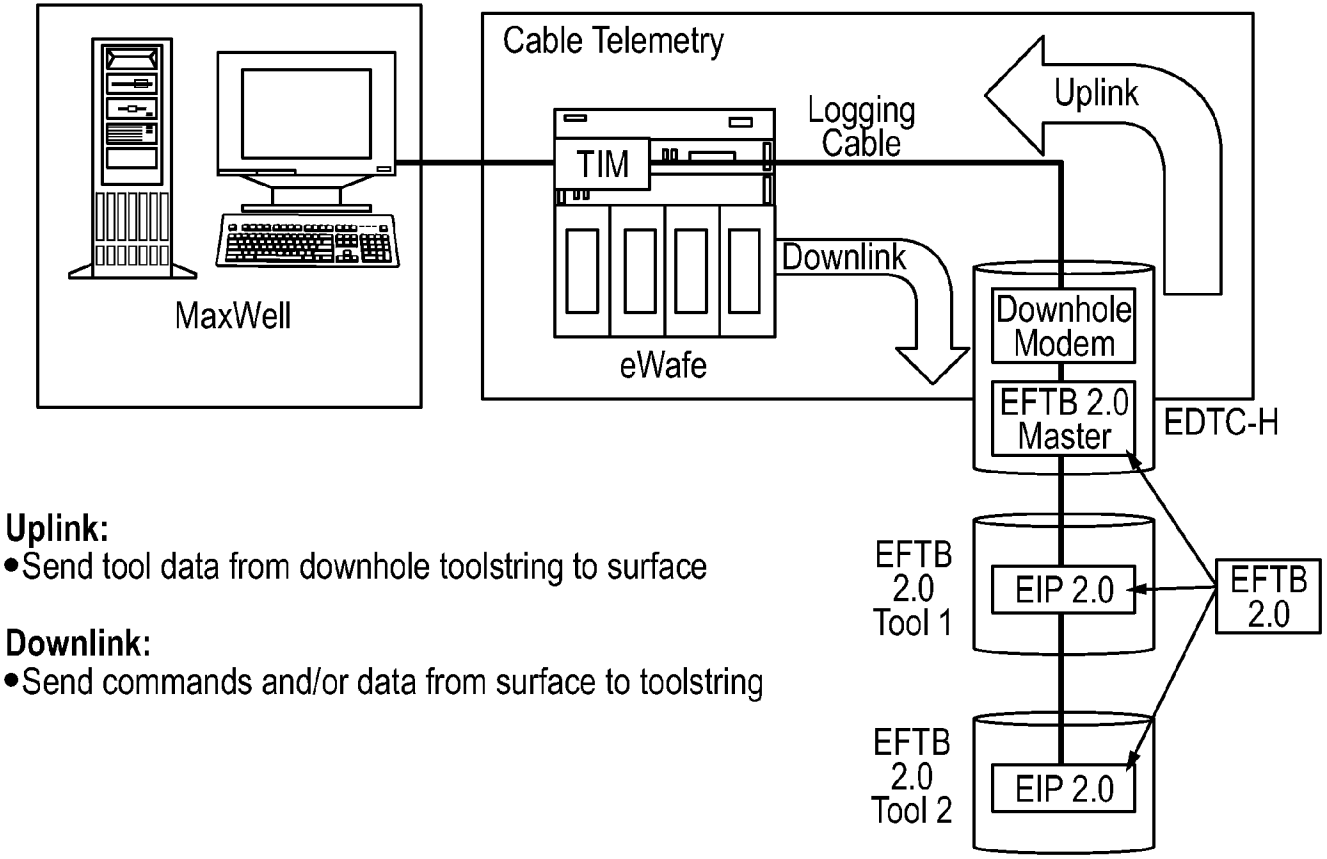
FIG. 6 is a schematic diagram illustrating project organization for a wireline telemetry system in accordance with the present disclosure.

FIG. 6 shows project organization for a wireline telemetry system in accordance with the present disclosure, which may be SCHLUMBERGER's™ Enhanced Digital Telemetry System EDTS 2.0. FIG. 6 depicts uplink and downlink through the system and its downhole tools 1 and 2. The system of FIG. 6 may be similar to the systems of FIGS. 1 and 2.

The system can include an EDTS 2.0 Cable Telemetry. This is the firmware supporting the cable telemetry system described herein and hosted and run by the Telemetry Interface Module (TIM) residing in the enhanced Wireline Acquisition Front End (eWAFE) system.

The system can also include an Enhanced Digital Telemetry Cartridge EDTC-H: This is the downhole telemetry cartridge that communicates with the wireline tools. The system can also include an Enhanced Fast Tool Bus EFTB 2.0. This is the downhole telemetry bus with the Enhanced Interface Package (EIP) 2.0 that has higher capacity than the existing EFTB system. The system can also include a MAXWELL framework. This software allows for configuration, control and data acquisition with EDTS 2.0.

Figure 7:
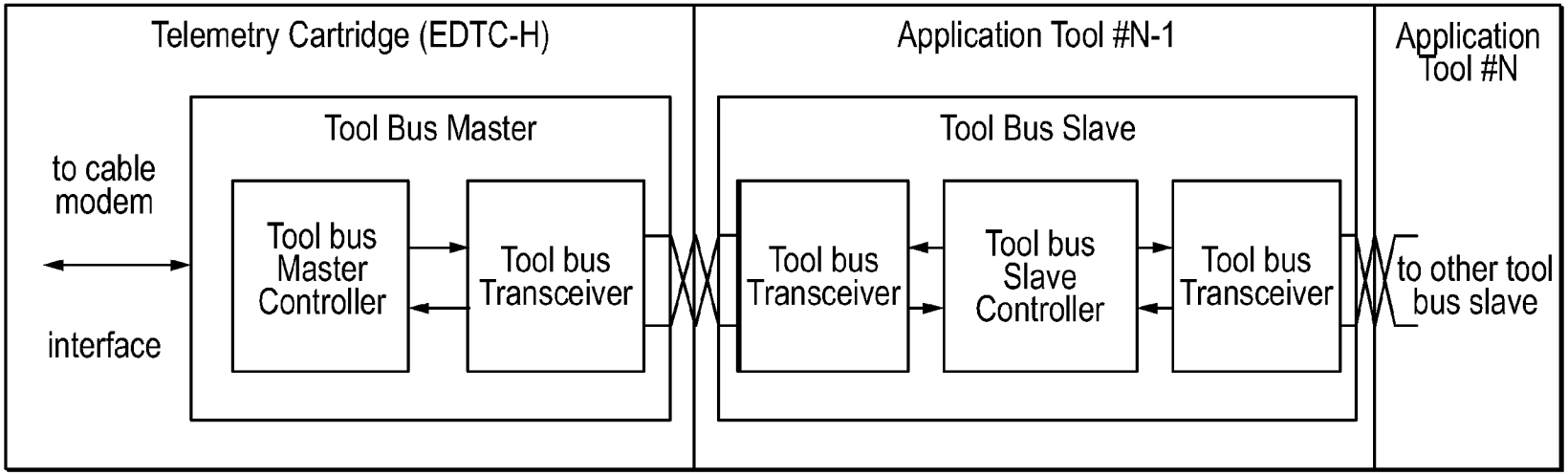
FIG. 7 is a block diagram illustrating an example tool bus master and tool bus slave in accordance with the present disclosure.

FIG. 7 shows a block diagram of an example tool bus master and tool bus slave. The tool bus may be used to interface between cable telemetry and wireline tools. Wireline tools are physically connected below the telemetry cartridge, EDTC-H. Tool bus communication is established between the tool bus master and the tool bus slave through tool bus transceiver and cable shown in FIG. 7. Tool bus master is installed in the telemetry cartridge at the top of the toolstring 116, and multiple tool bus slaves are respectively installed in the serially-connected application tools, with one tool slave in one tool.

Wireline application tools may be used to log the well and measure the properties of their environment according to their design and the particular user-selected application workflow, and send them as tool data to tool bus. The tool bus master collects the tool data through tool bus slave controller and passes them to a cable modem. The tool bus master distributes the tool commands from the cable modem to each application tool via a tool bus slave controller so that the tool can be operated in appropriate workflow.

There are several tool bus versions that may be used in SCHLUMBERGER™'s wireline tools. They are depicted in order of design date Downhole Tool bus (DTB), Fast Tool Bus (FTB), Enhanced Fast Tool Bus (EFTB). EFTB 2.0 is designed as an alternative to its predecessor EFTB and may support up to about 8 Mbps of uplink data rate, which is about 4 times the data rate of EFTB.

EDTS 2.0 may support EFTB and FTB legacy tools, and embodiments of the present disclosure may use EFTB 2.0. DTB is supported in the presence of a tool bus adapter called Digital Telemetry Adapter (DTA) or Enhanced Digital Telemetry Adapter (EDTA). The others may be natively supported by EDTS 2.0. This configuration may be provided to allow any tool using the mentioned tool bus to be supported in EDTS 2.0.

The evolutions of cable telemetry, tool bus adapter and tool bus are summarized below. Tool bus slaves may include an Interface Package (IP) for Fast Tool Bus (FTB), an Enhanced Interface Package (EIP) for Enhanced Fast Tool Bus (EFTB), and an EIP 2.0 for Enhanced Fast Tool Bus (EFTB) 2.0, respectively. An EIP can behave as an IP or an EIP depending on the configuration and similarly EIP 2.0 can behave as IP, EIP or EIP 2.0.

Topology refers to the way the tools are assembled together in a toolstring, such as toolstring 116 of FIG. 1. More precisely, in this context, topology refers to the way the tool bus is constituted using the tool bus slave modules. Thus, topology investigation is meant to create the "Topology Map" of the tool bus slaves connections and capabilities, e.g., it may be used to show that a Tool 1 has an Enhanced Interface Package (EIP) 2.0 tool bus slave and is connected to Tool 2 that has an older generation Interface Package IP bus slave etc. The tool bus master (EFTB 2.0 master, residing in telemetry cartridge EDTC-H) queries the node and the node responds with the requested information. An example topology investigation is described with respect to FIG. 3 and using the methods of FIGS. 4 and 5.

Topology investigation is the responsibility of the tool bus master residing in EDTC-H and may start about 5 seconds after the tool bus master determines that the head voltage is in a normal range. This 'waiting time' allows enough wake-up time for tools and duration to be adjusted during development. Thus, the topology investigation may not depend on surface commands or a successful cable training phase.

During a topology investigation phase (and also later until the system is up), certain system messages from EDTC-H may be sent to a surface computer data dispatcher, such as a MAXWELL™ framework. During this phase, the MAXWELL™ applications may not send commands to downhole tools and tool messages may not be sent to the applications (tool specific add-ons to the MAXWELL™ framework).

Topology investigation processes may take less than about 1 second to complete, and hence may be available before completion of cable telemetry training, which may occur in less than about 8 seconds. The result of the topology is the "Topology Map," which may be stored in the tool bus master.

The tool bus master may send the "Topology Map" to the surface using EDTC-H tool message as soon as it is completed and as soon as the cable link telemetry is up. The user of the "Topology Map" can be MAXWELL™ framework.

MAXWELL™ framework compares the "Topology Map" with the tool selection acquired from the user with the MAXWELL™ setup console. If the number of tools doesn't match, the "Start Topology" command may be sent to the EDTC-H. In case of tool detection failure, MAXWELL™ may repeat up to 3-times.

The topology map and tool selection information may be reconciled using, for example, the MAXWELL™ framework. This stage contains two phases: comparison and slave node mode setting. Comparison may be performed using MAXWELL™ framework to compare the Topology Map with toolstring 116 information obtained during the MAXWELL™ Setup Console. During this stage, MAXWELL™ is looking for inconsistencies between the toolstring topology map and its own MAXWELL™ setup console.

Slave node mode setting may involve the use of the MAXWELL™ framework to decide on the setting of slave nodes mode of operation based on, for example, the serial connections, node capabilities and the system settings.

The MAXWELL™ framework may be used to compare the topology map with toolstring information obtained during the MAXWELL™ setup console. A mismatch may occur between the topology map and the MAXWELL™ setup console, for example where a MAXWELL™ database storing the characteristics of each tool may not be up-to-date with the particular tool asset used in the particular job (the tool may have been upgraded). In another example, the field engineer may have placed the tool in a wrong position in the toolstring 116. In yet another example, a wrong tool or a wrong file code may be selected in the MAXWELL™ setup console.

Figure 8:
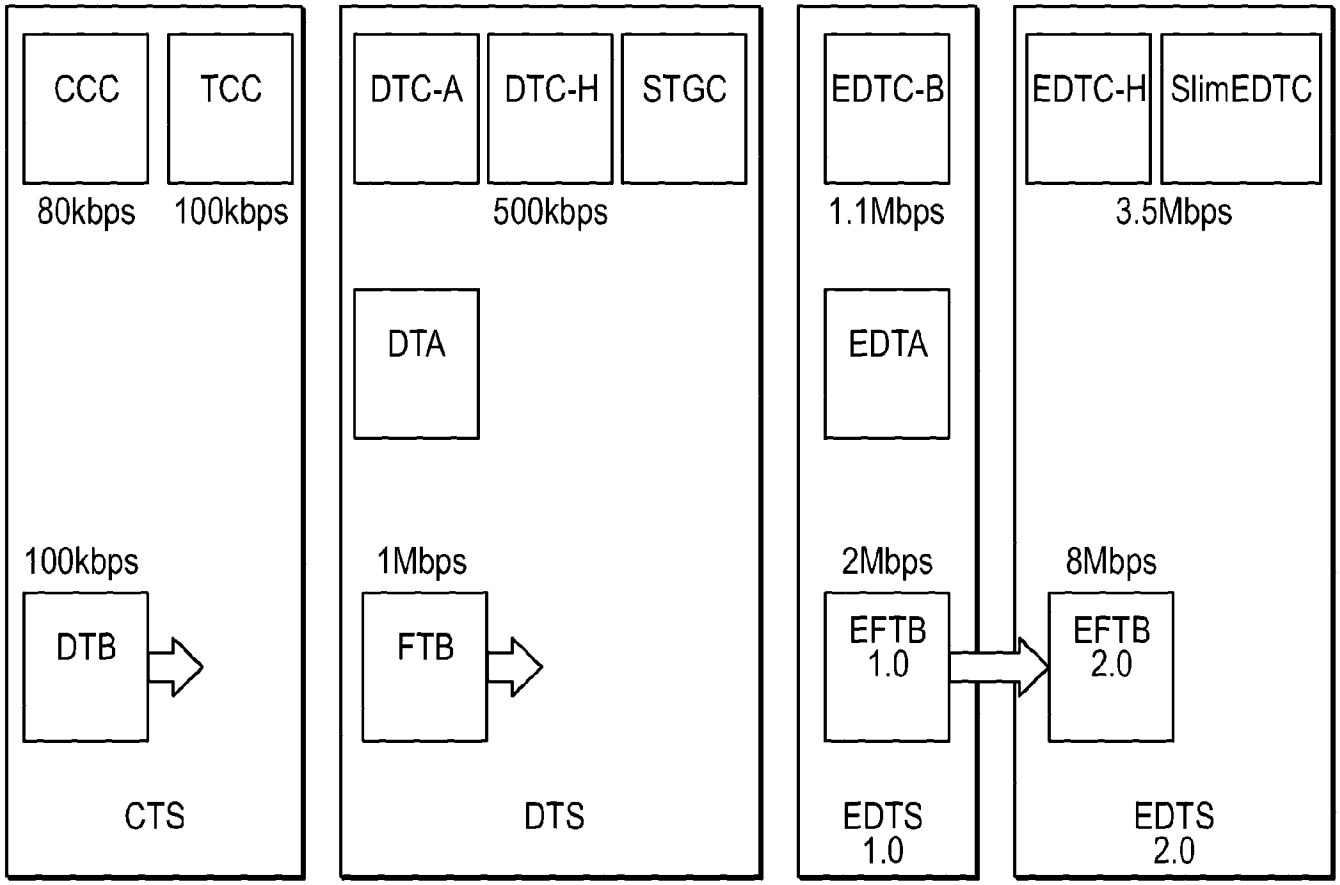
FIG. 8 is a block diagram illustrating associated modems with hardware tools running various interface packages in accordance with the present disclosure.

FIG. 8 is a block diagram illustrating associated modems with hardware tools running various interface packages in accordance with the present disclosure. In the first block on the left, a CCC telemetry cartridge configured for 80 kbps data communication or a TCC telemetry cartridge configured for 100 kbps data communication are associated with a Downhole Toolbus (DTB) configured for 100 kbps communication in a CTS cable telemetry system.

In the second block from the left, three telemetry cartridges DTC-A, DTC-H, and STGC, for 500 kbps data communication are associated with a Digital Telemetry Adapter (DTA) for a Fast Tool Bus (FTB) configured for 1 Mbps communication in a Digital Telemetry System (DTS) cable telemetry system.

In the third block from the left, a telemetry cartridge EDTC-B for 1.1 Mbps data communication is associated with an Enhanced Data Telemetry Adapter (EDTA) for an Enhanced Fast Tool Bus (EFTB) configured for 2 Mbps communication in an Enhanced Data Telemetry System (EDTS) Cable Telemetry system.

In the fourth block from the left, two telemetry cartridges EDTC-H and Slim EDTC for 3.5 Mbps data communication are associated with an Enhanced Fast Tool Bus (EFTB) configured for 8 Mbps communication in an Enhanced Data Telemetry System (EDTS 2.0) Cable Telemetry System.

Figure 9:
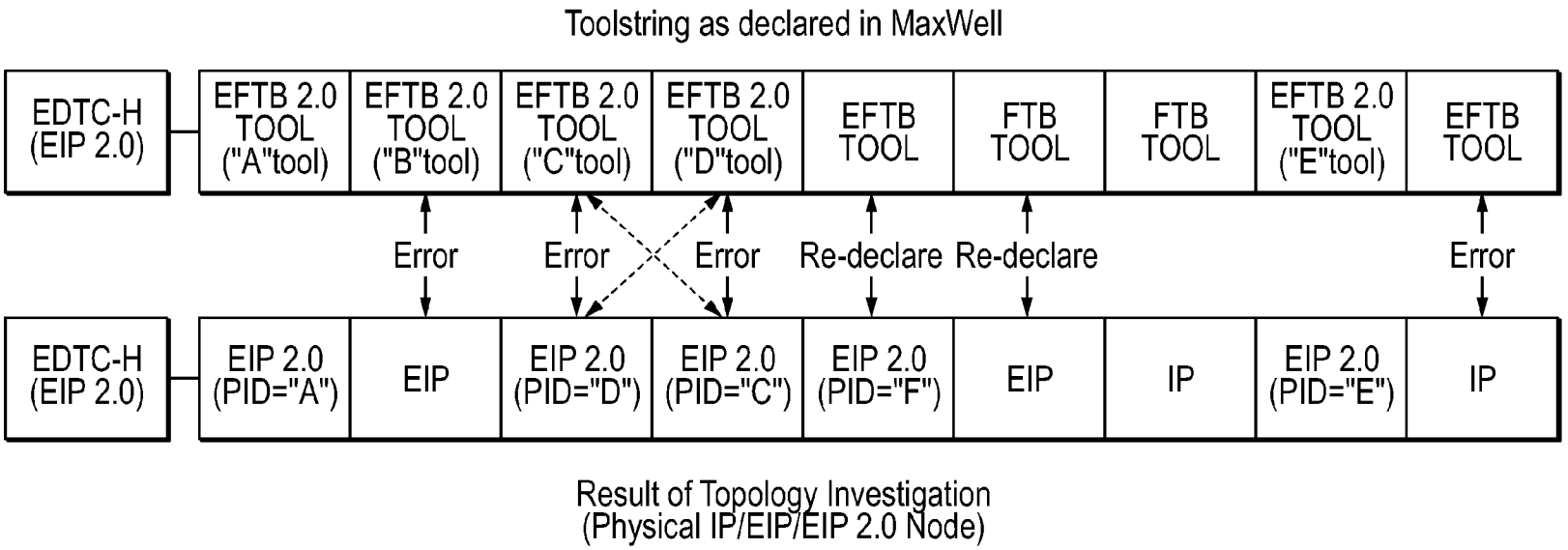
FIG. 9 is a block diagram illustrating an input toolstring as entered by a user during setup compared to a topology map resulting from a topology investigation in accordance with an embodiment of the present disclosure.

FIG. 9 shows an example selected toolstring (top) and reported (physical) toolstring mismatch (similar to what is shown in FIG. 3, and discussed in detail with respect thereto). The mismatches occur where "Error" or "Re-declare" is shown between the declared toolstring (as entered by the user) and the topology map as reported from the actual hardware and firmware. Specifically, considering the nine tools coupled to the EDTC-H at left and counting left to right, an error is shown for the second, third, fourth, and ninth tool. A re-declare is shown, specifically, for the fifth and sixth tools.

Table 1 shows actions and messages by MAXWELL Framework™ in case of mismatch. The actions taken by the system to remedy the mismatches may be shown to the user and logged for future reference. Table 1 shows the mismatch between tool declaration in MAXWELL™ and topology map.

TABLE 1

| MAXWELL ™ Tool Declaration | Tool Capability From Topology Map | Action | User Notification |
|---|---|---|---|
| IP (FTB tool) | EIP | Re-declare tool to be EIP | Event will be logged |
| EIP (EFTB tool) | IP | (error, cannot proceed) | Error |
| a mismatch with the tool capabilities column | EIP 2.0, PID = "xx" | If a corresponding EIP 2.0 tool is found in the MAXWELL ™ Tool Declaration | Error: Tool misplaced in the toolstring |
| | | Else if an IP or EIP is declared in MAXWELL ™ then re-declare tool to be EIP 2.0 | Event will be logged |
| | | Else (error, cannot proceed) | Error |
| EIP 2.0 (EFTB 2.0 Expected PID = "yy") | a mismatch with the declaration column | If a corresponding EIP 2.0 tool is found in Topology Map | Error: Tool misplaced in the toolstring |
| | | Else (error, cannot proceed) | Error |

If a mismatch related to an EIP 2.0 is found and the user declares an EFTB 2.0 tool in MAXWELL™ (meaning an EIP 2.0 with Physical Node ID (PID)="xx" should be present in a particular position X in the toolstring 116) but the tool in position X is not the expected tool, MAXWELL™ may be used to search the topology map to find out if the EIP 2.0 with corresponding PID exists or not. If there is such a node, the tool connection order may be wrong. The "Tool misplaced in the toolstring" error message may be displayed in the MAXWELL™ console manager and the event is logged for later reference.

If EIP 2.0 with a different PID or EIP/IP is declared, an error message is displayed in the MAXWELL™ console manager and the event may be logged as well for later reference.

Also, if an EIP 2.0 with Physical Node ID (PID)="xx" is found in the Topology Map and the declared tool in MAXWELL™ is not matching, MAXWELL™ may search the tool declaration to find out if there is such a tool (e.g., EFTB 2.0 tool with PID="xx") declared. If there is such a tool, the tool connection order may be wrong. The "Tool misplaced in the toolstring" error message may be displayed in the MAXWELL™ console manager and the event may be logged for later reference.

If an IP or EIP is declared in MAXWELL™, the physical tool may have been upgraded. MAXWELL™ may re-declare the tool in the EIP 2.0 mode, not IP or EIP. The event may be logged as well for later reference.

If the declared EIP 2.0 has a different PID, an error message can be displayed in the MAXWELL™ console manager and the event will be logged as well for later reference.

If the user declares an FTB tool in MAXWELL™ (meaning an IP is present for the slave node), but the actual tool is identified as EIP during topology investigation, MAXWELL™ may be used to re-declare the tool in the EIP mode, not IP. The event may also be logged as well for later reference.

Where an EFTB tool is shown in MAXWELL™, but the actual tool is identified as IP during topology investigation, the system cannot proceed because an IP cannot emulate an EIP. An error message is displayed in the MAXWELL™ console manager and the event may be logged as well for later reference.

Where an EFTB tool is shown in MAXWELL™, but the actual tool is identified as EIP 2.0 tool during topology investigation, MAXWELL™ may re-declare the tool in the EIP 2.0 mode as not EIP. The user may be informed of the mismatch in the MAXWELL™ console manager and the event may be logged as well for later reference.

Where an EFTB 2.0 tool is shown, but the actual tool was identified as EIP (an EFTB tool), the system cannot proceed. An error message may be displayed in the MAXWELL™ console manager and the event may be logged as well for later reference.

The slave node mode setting is the mode in which a tool bus slave will operate depending on, such as tool bus slave capabilities, telemetry cartridge selected, and position of the slave in the toolstring 116 vis-a-vis the capabilities of the tools above it.

MAXWELL™ framework may have the capability to inform the tool application whether the tool will be running in IP, EIP or EIP 2.0 mode, so that MAXWELL™ can disable EIP 2.0 features when it is running in EIP mode and can disable EIP/EIP 2.0 features when it is running in IP mode.

Figure 10:
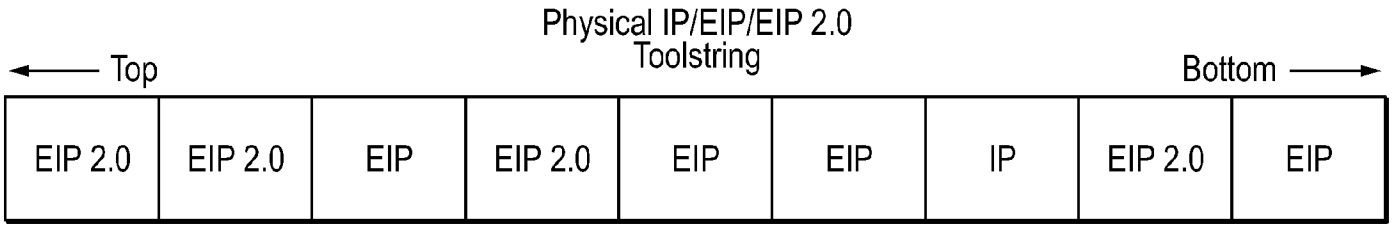
FIGS. 10-14 are block diagrams illustrating example toolstring configurations for a physical toolstring, a setup console, DTC-H, EDTC-B, and EDTC-H, respectively, in accordance with an embodiment of the present disclosure.

FIG. 10 shows an example toolstring, similar to that of FIG. 3, with the nodes depicted from left to right. The top 2 slave nodes and nodes 4 and 8 (counted from the left) are EIP 2.0 (i.e. able to operate as EIP 2.0, EIP or IP); nodes 3, 5 and 6 are EIP (therefore able to operate as EIP or IP); and node 7 is an IP.

Figure 11:
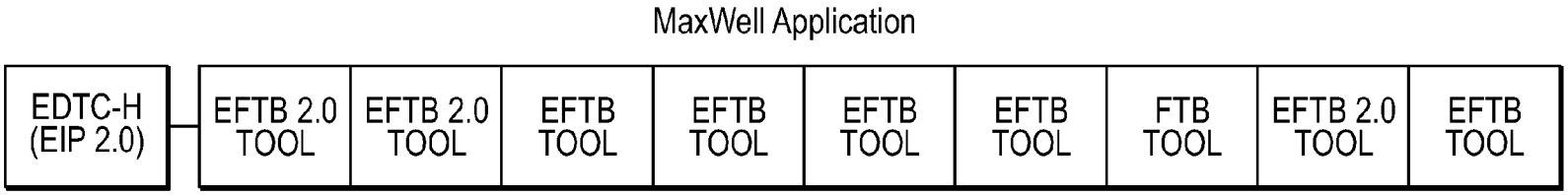
Figure 12:
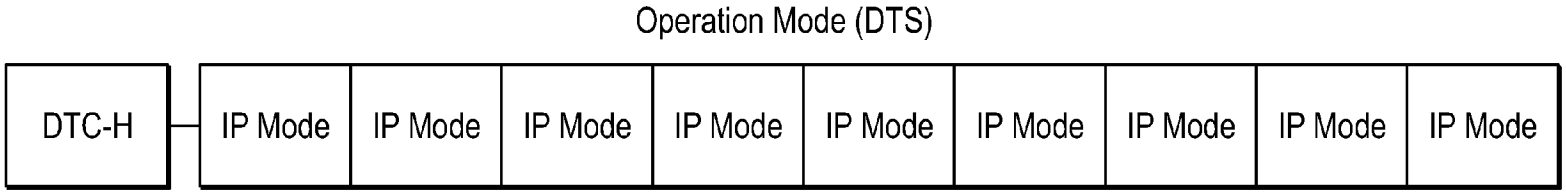
Figure 13:
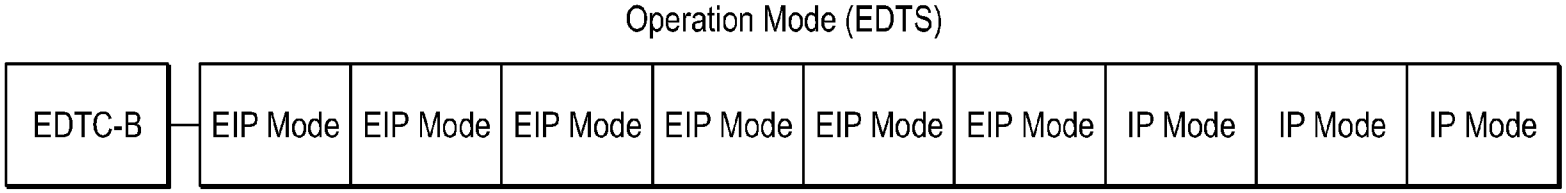
Figure 14:
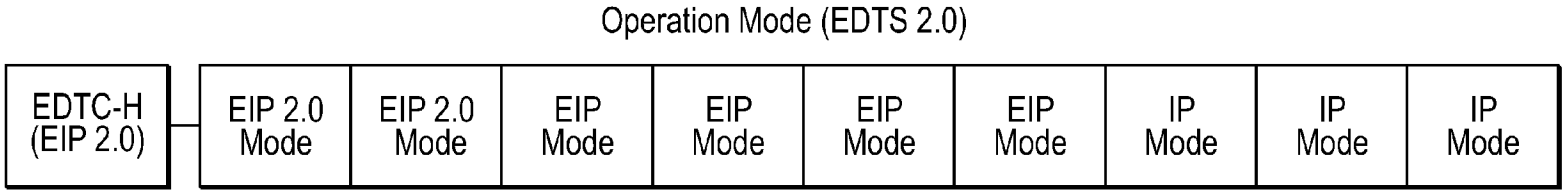

FIGS. 10-14 depict various toolstring configurations provided using the MAXWELL™ setup. FIG. 10 shows a physical IP/EIP/EIP 2.0 for a toolstring of various SCHLUMBERGER™ tools. FIG. 11 illustrates a toolstring example as declared in the MAXWELL™ setup console. FIG. 12 to FIG. 14 show the slave node configurations based on the toolstring examples herein, and the selected telemetry cartridge (SCHLUMBERGER™'s commercialized DTC corresponding to DTS generation, SCHLUMBERGER™'s commercialized EDTC-B corresponding to EDTS 1.0 generation, or SCHLUMBERGER™'s commercialized EDTC-H corresponding to EDTS 2.0 generation). Specifically, FIG. 12 illustrates a toolstring example with SCHLUMBERGER™'s commercialized DTC-H; FIG. 13 illustrates a toolstring example as configured for operation with SCHLUMBERGER™'s commercialized EDTC-B; and FIG. 14 illustrates a toolstring example as configured for operation with SCHLUMBERGER™'s commercialized EDTC-H. FIGS. 10-14 are relevant as example embodiments of actual toolstrings, which may be queried and mapped according to methods of the present disclosure.

Figure 15:
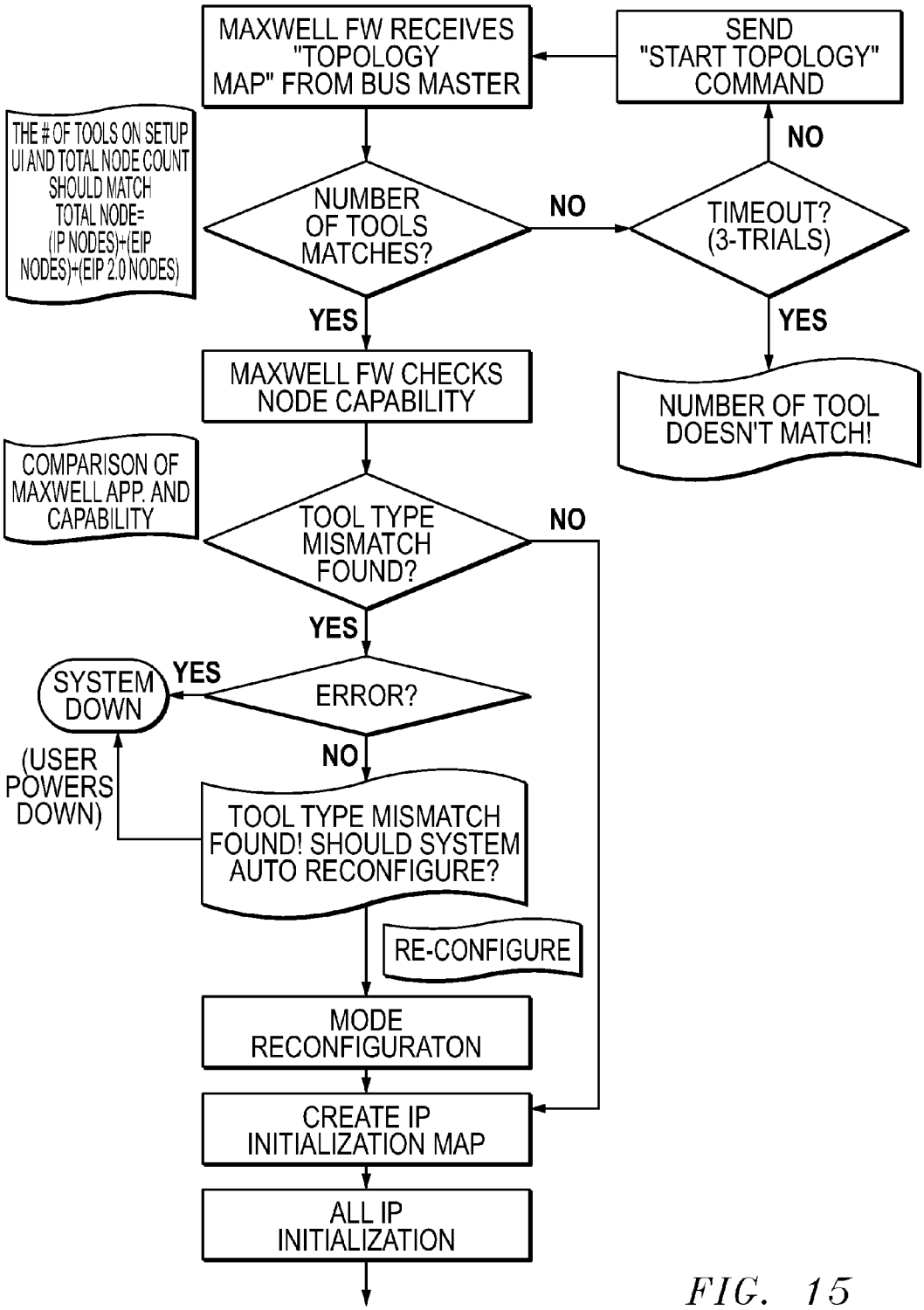
FIG. 15 is a flow chart illustrating a method for determining toolstring settings in accordance with an embodiment of the present disclosure.

FIG. 15 shows an example method used in MAXWELL™ to arrive at the final settings of the toolstring. The method may be similar to that of FIG. 5. Where mismatches occur, messages are displayed to the user. If the system decides that the tool can be re-configured per, e.g., Table 1, then the system may ask the field engineer to re-declare or choose whether the system should take reconfigure or not. For example, in case of mismatch, the field engineer may choose to change the tool as opposed to re-configuring it, so he/she can select "NO" and proceed. After the mode configuration, MAXWELL™ framework calculates window size and delay and prepares a set of configuration parameters for tool bus configuration. As depicted by this method, the number and types of tools may be compared to determine if a mismatch occurs, and alert the user to correct or power down if there is a mismatch.

Figure 16:
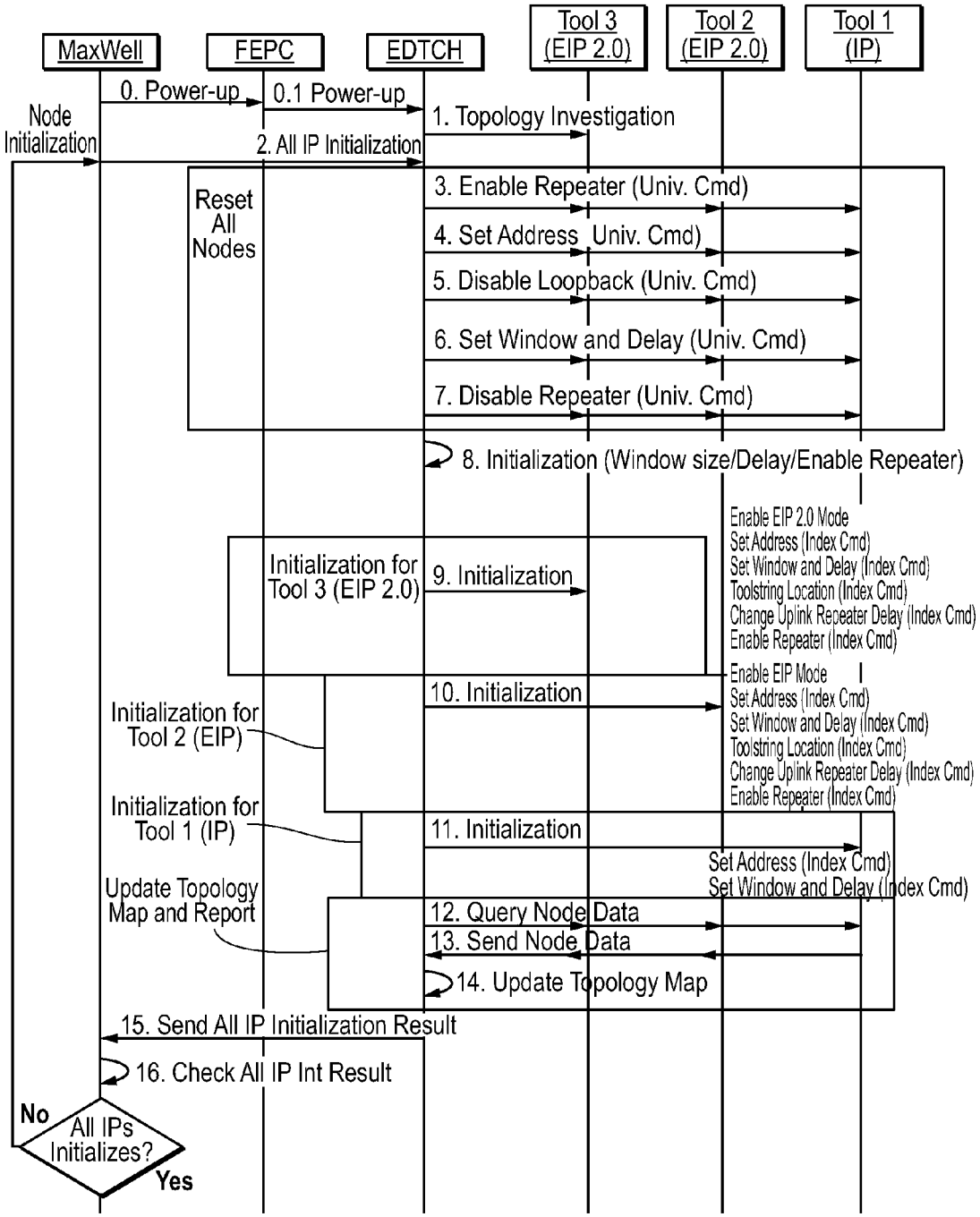
FIG. 16 is a schematic diagram illustrating a topology comparison method in accordance with an embodiment of the present disclosure.

FIG. 16 illustrates a topology comparison and mode setting phase. The result of tool bus configuration with EDTC-H stage is a set of configuration parameters to be sent to the toolstring which may be used to ensure proper functioning of the toolstring according to the data used in the application and capabilities of the cable telemetry.

The topology comparison method of FIG. 16 includes items 1-16 involving node initialization, node reset, tool initializations, initialization results and result checks. The various items 1-16 are performed to provide the communication across the various tools, in this case tools 1-3. At 0, the surface data acquisition computer 118 (e.g., in an embodiment, SCHLUMBERGER™'S MAXWELL™) powers up, and causing the flow controller software module (FEPC) 224 to power up at 0.1 At 1, the EDTCH (DTC 226) begins the topology investigation as described above.

At 2, the surface data acquisition computer 118 sends a command to the FEPC 224, the DTC 226, and the tools to initialize the interface packages. At 3, the DTC 226 sends a universal command to enable repeating of data from one tool to the next. At 4, the DTC 226 sends a universal command to set an address for repeating data from one tool to the next. At 5, the DTC 226 sends a universal command to disable loopback between the tools. At 6, the DTC 226 sends a universal command to set a window and delay for repeating data from one tool to the next. At 7, the DTC 226 sends a universal command to disable repeating of data from one tool to the next. 3-7 may be referred to as resetting the nodes.

At 8, the DTC 226 sends a command for initialization that sets the window size and delay, and enables repeating of data from one tool to the next.

At 9, FEPC 224 and DTC 226 send the initialization commands to Tool 3, running EIP 2.0. These commands may include, for example, but not limited to, enabling EIP 2.0 mode, setting the address with an index command, setting window and delay with an index command, setting toolstring location with an index command, setting or changing an uplink repeater delay with an index command, and enabling the repeating with an index command.

At 10, FEPC 224 and DTC 226 send the initialization commands to Tool 2, running EIP. These commands may include, for example, but not limited to, enabling EIP mode, setting the address with an index command, setting window and delay with an index command, setting toolstring location with an index command, setting or changing an uplink repeater delay with an index command, and enabling the repeating with an index command.

At 11, FEPC 224 and DTC 226 send the initialization commands to Tool 1, running IP. These commands may include, for example, but not limited to, setting the address with an index command, and setting window and delay with an index command.

At 12, DTC 226 queries tool 1, tool 2, and tool 3 for node data, as described above. At 13, tool 1, tool 2, and tool 3 send node data back to the DTC 226 in response to the query. At 14, the DTC 226 updates the topology map based on the node data sent in 13.

At 15, DTC 226 sends the interface package initialization result and topology map to surface data acquisition computer 118. At 16, surface data acquisition computer 118 checks the result of the interface package initialization, and if the interface package for each tool in the toolstring is initialized, the method is completed, and if not, the method returns to 2.

Tool bus configuration involves passing the configuration parameters to the tool bus master and tool bus slaves. EDTC-H tool bus master initializes tool nodes to either IP or EIP or EIP 2.0 based on the configuration data received from MAXWELL™ framework via a downlink command called "All IP Initialization". EDTS (the predecessor of EDTS 2.0) may be used to perform this function, but may require that the surface system initialize each slave node separately from the surface without any feedback. An embodiment used in EDTS 2.0 may be used to send the configuration data to the tool bus master and allow it to configure the toolstring. The tool bus master receives the configuration data and proceeds to configure the tool bus slaves.

After the tool bus master configures the slave nodes, the tool bus master may proceed to update the topology map by querying the slave nodes about their actual configuration. The query may be used to gather the information about whether the configuration of the nodes was successful or not. The updated topology map is sent by the tool bus master to MAXWELL™ framework. MAXWELL™ framework compares the updated topology map with the intended tool bus configuration. If there are discrepancies, MAXWELL™ framework logs the information for later analysis and repeats tool bus configuration. The whole configuration may be repeated, for example, up to 3 times, after which MAXWELL™ framework may declare an error if the discrepancies were still found. The user may be informed, and the tools displayed where the discrepancies were found. If there are no discrepancies, then the toolstring may be configured properly and the process moves to the next phase "System Up". For diagnostics and development, MAXWELL™ framework also then sends the map information to eWAFE FEPC as a XML Configuration (following DTS/MTS/EDTS current format) as shown in the example tool bus initialization scheme of FIG. 16.

Although a few example embodiments have been described in detail above, those skilled in the art will readily appreciate that many modifications are possible in the example embodiments without materially departing from this disclosure. Accordingly, such modifications are intended to be included within the scope of this disclosure as defined in the following claims. In the claims, means-plus-function clauses are intended to cover the structures described herein as performing the recited function and not simply structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. A method for cable deployed toolstring topology mapping, comprising:

providing a downhole toolstring comprising:

a master node controller provided downhole; and one or more tools each with a respective node;

receiving expected input topology information from a user interface of a surface computer operatively coupled to the downhole toolstring via a cable prior to querying by the master node controller, wherein expected input topology information is selected from a group consisting of: an input number of tools in the toolstring, an input tool identifier for each node of the toolstring, an input interface package identifier for each node of the toolstring, an input relative order of the tools in the downhole toolstring, and combinations thereof;

querying by the master node controller of each of the nodes in the one or more tools for actual topology information;

receiving the actual topology information from each of the nodes in response to the querying;

generating a fixed topology map of the downhole toolstring based on the actual topology information; and verifying the fixed topology map by comparing the fixed topology map with the input topology information.

2. The method according to claim 1, further comprising storing the topology map at the master node controller.

3. The method according to claim 1, wherein verifying the fixed topology map is performed the surface computer.

4. The method according to claim 3, further comprising generating an alert for a topology mismatch between the input topology information and the topology map.

5. The method according to claim 4, wherein the topology mismatch indicates one or more of:

1) an expected input number of the one or more tools does not match an actual number of the one or more tools, 2) an expected input tool identifier for a single node of the nodes does not match an actual tool identifier for the single node, 3) an expected input identifier for an interface package for a single node of the nodes does not match an actual identifier for the interface package for the single node, and 4) an expected input relative order of the one or more tools does not match an actual relative order of the one or more tools.

6. The method according to claim 4, further comprising halting tool-specific bi-directional communications in response to an adequate head voltage measurement at the master node controller.

7. A system for cable deployed downhole toolstring topology mapping comprising:

a downhole toolstring comprising one or more tools each with a respective node, and further comprising a master node controller provided downhole, wherein in response to powering up the downhole toolstring, the master node controller queries each of the nodes in the respective tools for actual topology information and generates a fixed topology map of the downhole toolstring;

a surface computer comprising a user interface that receives expected input topology information relating to each of the nodes prior to querying each of the nodes, wherein expected input topology information is selected from a group consisting of: an input number of tools in the toolstring, an input tool identifier for each node of the toolstring, an input interface package identifier for each node of the toolstring, an input relative order of the tools in the downhole toolstring, and combinations thereof, wherein the surface computer is configured to verify the fixed topology map with the expected input topology; and a cable operatively coupling the downhole toolstring and the surface computer.

8. The system according to claim 7, wherein the topology map comprises one or more of:

an actual number of the one or more tools;

an actual tool identifier for each of the nodes;

an actual identifier for an interface package for each of the nodes; and an actual relative order of the one or more tools.

9. The system according to claim 7, wherein the surface computer further comprises a memory module that stores the topology map, and the user interface is configured to display the topology map.

10. The system according to claim 7, wherein the surface computer further comprises a data routing module that, upon receipt of the topology map from the master node controller, compares the input topology information and the topology map, and generates an alert for a topology mismatch between the input topology information and the topology map.

11. The system according to claim 10, wherein the topology mismatch indicates one or more of:

1) an expected input number of the one or more tools does not match an actual number of the one or more tools, 2) an expected input tool identifier for a single node of the nodes does not match an actual tool identifier for the single node, 3) an expected input identifier for an interface package for a single node of the nodes does not match an actual identifier for the interface package for the single node, and 4) an expected input relative order of the one or more tools does not match an actual relative order of the tools.

12. A system for downhole toolstring topology mapping comprising:

a downhole toolstring comprising;

a downhole telemetry cartridge comprising a master node provided downhole; and one or more tools each with a respective node;

a surface computer comprising a user interface that receives expected input topology information relating to each of the respective nodes of the one or more tools and uses the expected input topology information to generate an input topology map prior to querying each of the respective nodes, wherein expected input topology information is selected from a group consisting of: an input number of tools in the toolstring, an input tool identifier for each node of the toolstring, an input interface package identifier for each node of the toolstring, an input relative order of the tools in the downhole toolstring, and combinations thereof; and a cable operatively coupling the downhole telemetry cartridge to the surface computer;

wherein the master node queries each of the respective nodes in the one or more tools to generate the fixed actual topology map that is communicated to the surface computer for comparison to the input topology map and for identification of any topology mismatches.

13. The system according to claim 12, wherein the topology mismatch indicates one or more of:

1) an expected input number of the one or more tools does not match an actual number of the one or more tools, 2) an expected input tool identifier for a single node of the nodes does not match an actual tool identifier for the single node, 3) an expected input identifier for an interface package for a single node of the nodes does not match an actual identifier for the interface package for the single node, and 4) an expected input relative order of the one or more tools does not match an actual relative order of the tools.

14. The system according to claim 12, wherein the master node controller generates the actual topology map automatically, after at least one of a predetermined period of time elapses or after determining that the toolstring is powered up.

15. The system according to claim 12, wherein each of the one or more tools further comprises:

an interface package.

16. The system according to claim 12, wherein an alert is generated for any of the topology mismatches.

* * * * *